United States Patent [19]

Tones

[11] 4,407,634

[45] Oct. 4, 1983

[54] AXIAL-FLOW STEAM TURBINE WHEEL

[75] Inventor: John Tones, Heddon on the Wall, United Kingdom

[73] Assignee: Northern Engineering Industries plc, Newcastle upon Tyne, England

[21] Appl. No.: 407,875

[22] Filed: Aug. 13, 1982

[30] Foreign Application Priority Data

Sep. 8, 1981 [GB] United Kingdom ..... 8127167

[51] Int. Cl.[3] ..... F01D 5/22

[52] U.S. Cl. ..... 416/196 R; 416/500

[58] Field of Search ..... 416/190, 195, 191, 196 R

[56] References Cited

U.S. PATENT DOCUMENTS

| | | | |
|---|---|---|---|
| 937,006 | 10/1909 | McKee | 416/196 R |
| 3,180,616 | 4/1965 | Miller | 416/196 R |
| 3,527,546 | 9/1970 | Zeman | 416/196 R |
| 3,708,244 | 1/1973 | Dawson | 416/196 R |
| 4,025,232 | 5/1977 | Imai et al. | 416/196 R X |

FOREIGN PATENT DOCUMENTS

| | | | |
|---|---|---|---|
| 818806 | 10/1951 | Fed. Rep. of Germany | 416/196 |
| 2711409 | 8/1978 | Fed. Rep. of Germany | 416/196 R |
| 280619 | 5/1952 | Switzerland | 416/196 R |
| 1499586 | 2/1978 | United Kingdom | 416/190 |
| 397665 | 1/1974 | U.S.S.R. | 416/196 R |

*Primary Examiner*—Everette A. Powell, Jr.

[57] ABSTRACT

Flutter of the tip sections of the blades of an axial-flow steam turbine wheel is inhibited by interconnection of the blades by ball-ended elongate members which are pre-stressed in compression. Each member exerts thrusts on two adjacent blades to pre-stress the blades torsionally each in a sense corresponding to untwisting of the blades. The thrusts are each exerted on the respective blade through socket elements received in respective openings in the blades. Either one or each socket element of each member is in screw-threaded engagement in its opening. Where only one is so engaged, the other is a close sliding fit in its opening.

5 Claims, 3 Drawing Figures

AXIAL-FLOW STEAM TURBINE WHEEL

BACKGROUND TO THE INVENTION

The invention relates to axial-flow steam turbine wheels.

The blades of the wheels of axial-flow steam turbines are of twisted form typically where the ratio of blade height to stage diameter is large. Centrifugal stress elastically deforms the blades in the untwisting sense. Where the blades are relatively long and move at relatively high speeds, for example in the final low pressure stage of a large turbine, the centrifugal stress is relatively high and may cause blade tip sections to turn by as much as 10° in the untwisting sense.

It is known to use shrouding or lacing on such blades to raise the fundamental frequency of vibration of the blades to inhibit flutter of the tip sections.

The tendency of the blades to untwist under the centrifugal stress causes stress and distortion of the shrouding or lacing which can lead the shrouding or lacing to fail. However, if the shrouding or lacing is strong enough to resist untwisting of the blades, torsional stress is also imposed on the blades in addition to centrifugal stress and vibration. Such a combination of stresses may well become unacceptable.

BRIEF SUMMARY OF THE INVENTION

The object of the invention is to provide a turbine wheel in which the blades are relatively free to untwist under centrifugal stress but in which flutter of the blade tip sections is inhibited.

A steam turbine wheel according to the invention comprises blades each of twisted form and each including a tip section and elongate members which are interposed between said tip sections of said blades and which are effective to inhibit flutter of said tip sections; said wheel further comprising for each said elongate member two ball-and-socket arrangements one at each end of each said elongate member, each said elongate member extending between the tip sections of two of said blades said two blades being mutually adjacent blades, each said elongate member being prestressed in compression so as to exert thrusts on said two blades to pre-stress said two blades torsionally each in a sense corresponding to untwisting of said twisted form of said blade, each said thrust being exerted on the respective one of said two blades through a respective one of said ball-and-socket arrangements.

Preferably, each said ball-and-socket arrangement comprises a ball element connected to said elongate member and a socket element, said ball element being retained in said socket element, each said blade tip section comprising means defining an opening therein in which the respective socket element is located.

Forms of wheel for an axial-flow stream turbine will now be described to illustrate the invention with reference to the accompanying drawings in which:

BRIEF DESCRIPTION OF THE DRAWNGS

Figure 1:
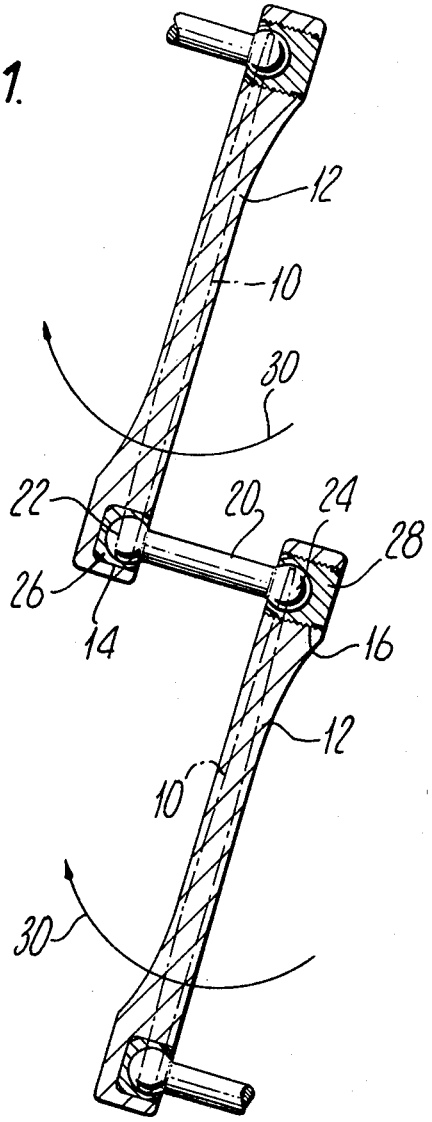
Figure 2:
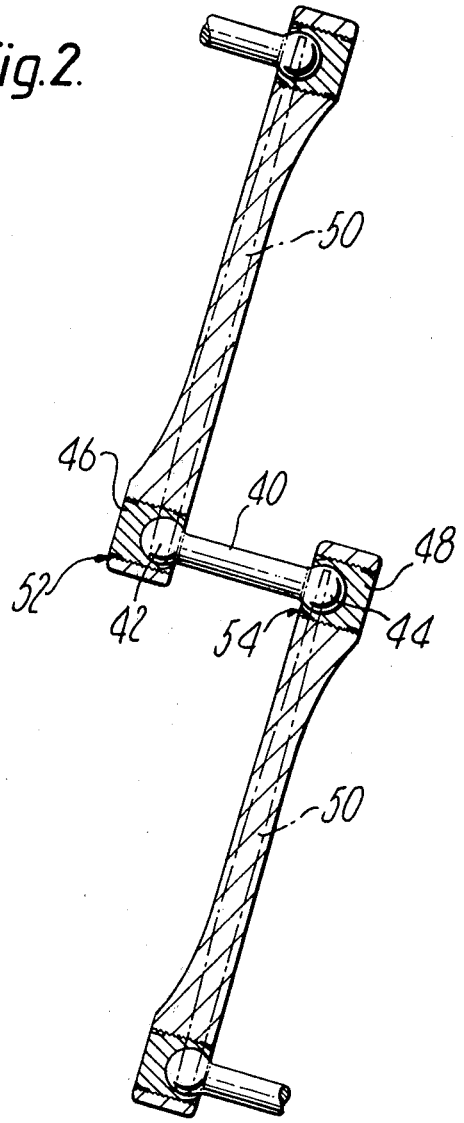
Figure 3:
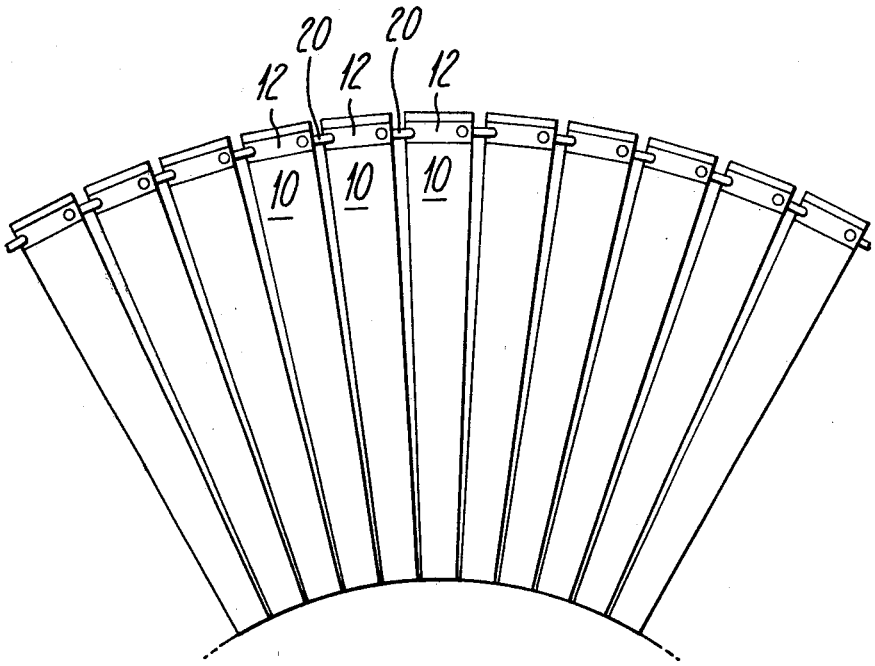

FIGS. 1 and 2 are diagrammatic developed sections through similar parts of two forms of wheel of a final low-pressure stage of an axial-flow steam turbine showing the tip sections of two adjacent blades the blades being of twisted form; and FIG. 3 is a diagrammatic view of a wheel which may be of either of the forms detailed in FIGS. 1 and 2.

FIG. 1 shows in ghost outlines at 10 the aerofoil shapes of the tip sections of two adjacent blades of a wheel of an axial-flow steam turbine. The two blades shown represent any two adjacent blades of the wheel, which is shown in FIG. 3. Each tip section comprises near its extremity a locally reinforced part 12, which extends transversely across the blade. Each reinforced part 12 has a cylindrical recess 14 adjacent the leading edge of the tip section and a threaded aperture 16 adjacent the trailing edge. The recess 14 in one blade is aligned with the aperture 16 in the adjacent blade.

The adjacent blades have interposed between them an elongate cylindrical steel member 20, which has integral ball elements 22, 24 at its ends. The ball 22 is trapped in a socket element in the form of a cylindrical steel bush 26, which is a close sliding fit in the recess 14 of one blade. The recess 14 is coaxial with a drilling (not shown) of smaller diameter which extends right through the reinforced part 12 to the side of the part remote from the recess 14 so that no air can be trapped beneath the bush 26 in the recess 14 and bottoming of the bush 26 on the base of the recess 14 is ensured.

The ball 24 is trapped in a socket element in the form of an externally threaded cylindrical steel bush 28 which is screwed into the aperture 16 in the adjacent blade.

The bush 26 can be passed through the aperture 16 to facilitate assembly of the members 20 with the blades. The bushes 28 are all screwed home until the bushes 26 just bottom against the bases of the recesses 14. When all the members 20 have been assembled in the wheel in that way, the bushes 28 are then screwed in increments of one turn into their apertures 16 successively round the wheel until the pre-determined total of turns to pre-stress the blades and the members 20 have been achieved. The members 20 are then locked in position. The bush 28 in each case is locked by peening an annular collar at its outer end (not shown) into a transverse slot (not shown) in the adjacent area of the reinforced part 12.

FIG. 1 shows the blades and members 20 in their final positions after locking of all the bushes 28.

The further turns of each bush 28 after the bush 26 has bottomed in the recess 14 introduce compressive pre-stress into the member 20 and introduce torsional pre-stress into each of the two adjacent blades, the number of further turns being appropriate to the desired compressive pre-stress. The torsional stressing of the blades is in the sense indicated by the arrows 30 in the drawing which is the sense in which the blades untwist under centrifugal stress when the wheel is rotating at relatively high speed in use.

The torsional stress introduced into the blades by the stressing of the members 20 is acceptable so long as centrifugal stress is absent or is below the value pertaining to full rotational speed of the wheel. as the wheel runs up to full speed, the centrifugal stress in the blades increases and the blades tend to untwist. The tip sections tend to turn in the sense of the arrows in the drawing so that the torsional stress in the blades and the compressive stress in the members 20 are reduced until at or near full speed, those stresses are preferably zero.

In a modification (not shown) the positions of the bushes 26 and 28 are inter-changed, the bush 28 then being adjacent the leading edge of the blade. In another modification (not shown) the members 20 or the bushes 26, 28 may be made of a material other than steel such as phosphor-bronze, for example.

FIG. 2 shows a modification in which, instead of the members 20 described above, the blades are interconnected by members 40 each of which has two ball elements 42, 44 trapped in respective identical screw-threaded socket elements 46, 48, one at each end. Each socket element has a right-handed screw-thread.

Each blade 50 has two identical internally screw-threaded through-apertures 52, 54 in which the socket elements 42, 44 are received, respectively, in each case.

The members 40 are installed as follows:

A special device (not shown) is inserted between two adjacent blades at the reinforced platforms and is operated to strain the blades torsionally in the sense corresponding to untwisting of the blades so as to increase their separation to a predetermined value. Next, a socket element (say 46) is screwed right through the opening 54 in one blade and is screwed almost right through the aperture 52 in the other blade. The socket element 48 had of course been screwed a short way into the aperture 54 meanwhile. Typically, for example, the socket element 46 now protrudes almost wholly to the left of the upper blade shown in FIG. 2 with two threads engaged in the aperture 52 and the socket element 48 protrudes almost wholly to the right of the lower blade shown in FIG. 2 with two threads engaged in the aperture 54. The special device is removed.

The same procedure is adopted at each pair of blades until all the members 40 are similarly positioned.

Next, at each member 40, the socket element 46 is given a half-turn to increase its threaded engagement with the aperture 52 (the sense of rotation being opposite to that used to screw the socket element 46 through the blade). The socket element 48 is also given a half-turn to increase its threaded engagement with the aperture 54. Then by further half-turns at each socket element of each member 40 progressively around the wheel, the required separation between the blades is achieved. Each blade is thus pre-stressed torsionally in the sense corresponding to the untwisting of the blade and each member 40 is pre-stressed in compression.

Each socket element is then locked in position in the same way as described for the construction shown in FIG. 1.

This procedure is carried out for each member 40 in succession around the wheel.

The use of screw-threaded socket elements 42, 44 at each end of each member 40 enables the requisite pre-compression in each member 40 to be achieved in wheels in which the blades 50 each have a relatively large amount of twist.

In a wheel having the form of construction described in relation to FIG. 2, it is possible for tension to be created in the members 40 during operation of the wheel. For example, should the wheel rotate at a speed above its normal full speed, a condition known as "overspeed", each member 40 continues to act on both blades to which it is connected, since after the pre-compression in the member 40 has fallen to zero, tension is then created in the member 40 as the speed of the wheel increases. Thus, there is no possibility that either socket element 42 or 44 can separate from the respective blade of the wheel. Furthermore, a socket element of the kind shown at 26 in FIG. 1 is always subject to friction in its movement in its recess 14 and the possibility exists that, for example at an overspeed condition, friction may prevent a blade from untwisting further. However, the continued tendency of the blade to untwist will cause the elongate member to be stressed in tension. The two respective blades would be correspondingly wrongly stressed and would also occupy anomalous positions in relation to the other blades of the wheel. The use of screwed socket elements at each end of the member 40 ensures that under all conditions of rotation of the wheel, the tip sections of certain blades do not adopt anomalous positions in that way in relation to other blades. The effects of the members 40 on the behaviour of the tip sections throughout the wheel can thus be better predicted.

FIG. 3 shows part of the turbine wheel including blade tip sections 10, platforms 12 and members 20, which latter members are shown by way of example only, and which are to be taken as equally representing the members 40 in an alternative construction.

Although in both forms of the wheel shown in the drawings the stress in members 20 or 40 is adjustable by means of adjustment of a socket element 28, 42 or 44, in the course of assembly of the wheel, such adjustability is not essential. In a further modification (not shown) such adjustability is dispensed with, the members being interposed between their respective blades while the latter are deflected away from one another by the use of a special device. Upon release of the blades the member is compressed between the blades so that the desired pre-compression is created in the member in each case.

For example, each member may have a ball element at each end trapped in a respective socket element similar to the element 26 shown in FIG. 1 and each blade tip section may have two cylindrical recesses similar to the recess 14 shown in FIG. 1. The blades may, for example, be deflected away from one another by means of a power tool suited specifically to that purpose.

In yet another modification (not shown) the socket elements 26, 28 or 42, 44 are dispensed with. Instead, sockets are formed in the tip sections of the blades. This construction is not preferred since the ball ends could not readily be trapped in such sockets. Some form of trapping or retention of the members is regarded as essential to avoid any possibility that a member 20 or 40 may become entirely detached from the wheel.

The ball-and-socket arrangements described above ensure that no bending moments and no stresses are induced at the socket elements during fitting of the elongate members 20 or 40 between the blades of the wheel. This is important since the apertures or recesses into which the socket elements are fitted may not be accurately aligned opposite one another in adjacent blades.

What is claimed is:

1. A steam turbine wheel comprising blades each of twisted form and each including a tip section and elongate members which are interposed between said tip sections of said blades and which are effective to inhibit flutter of said tip sections, said wheel further comprising for each said elongate member two ball-and-socket arrangements one at each end of each said elongate member, each said elongate member extending between the tip sections of two of said blades said two blades being mutually adjacent blades, each said elongate member being pre-stressed in compression so as to exert thrusts on said two blades to pre-stress said two blades torsionally each in a sense corresponding to untwisting of said twisted form of said blade, each said thrust being exerted on the respective one of said two blades through a respective one of said ball-and-socket arrangements.

2. A steam turbine wheel according to claim 1, in which each said ball-and-socket arrangement comprises a ball element connected to said elongate member and a socket element, said ball element being retained in said socket element, each said blade tip section comprising means defining an opening therein in which the respective socket element is located.

3. A steam turbine wheel according to claim 2, in which said means of one respective tip section defines an opening in the form of a recess having an end wall in which said socket element is located engaging said end wall and said means of the other respective tip section defines an aperture having a screw-threaded wall, said respective socket element having corresponding external screw-thread and being located in said aperture in screw-threaded relationship therewith.

4. A steam turbine wheel according to claim 2, in which said means of either tip section defines an aperture having a screw-threaded wall, the respective socket elements each having a corresponding external screw-thread and being located in a respective aperture in screw-threaded relationship therewith.

5. A steam turbine wheel comprising blades each of twisted form and each including a tip section and elongate assemblies which are interposed between tip sections of said blades and which are effective to inhibit flutter of said tip sections, each said elongate assembly extending between the tip sections of two of said blades said two blades being mutually adjacent blades, each said elongate assembly being pre-stressed in compression so as to exert thrusts on said two blades to pre-stress said two blades torsionally each in a sense corresponding to untwisting of said twisted form of said blade, each said elongate assembly comprising an elongate member extending between two ball-and-socket arrangements each said arrangement comprising a ball element retained in a socket element, one said element of each said arrangements being interconnected by said elongate member and the other said element being engaged with the respective blade tip section, each said elongate assembly further comprising screw-thread means which is subject to said pre-stress and which is adjustable to adjust said pre-stress during assembly of said wheel.

* * * * *